US007819516B2

(12) United States Patent
Groenenberg et al.

(10) Patent No.: US 7,819,516 B2
(45) Date of Patent: Oct. 26, 2010

(54) HEAT EXCHANGE LAMINATE

(75) Inventors: Cornelis J. Groenenberg, Venlo (NL); Herman Kuypers, Velden (NL); Peter J. Hollands, Baarlo (NL); Rick Walraven, Eindhoven (NL)

(73) Assignee: OCÉ-Technologies B.V., Venlo (NL)

( * ) Notice: Subject to any disclaimer, the term of this patent is extended or adjusted under 35 U.S.C. 154(b) by 50 days.

(21) Appl. No.: 12/254,474

(22) Filed: Oct. 20, 2008

(65) Prior Publication Data

US 2009/0047521 A1 Feb. 19, 2009

Related U.S. Application Data

(63) Continuation of application No. PCT/EP2007/053897, filed on Apr. 20, 2007.

(30) Foreign Application Priority Data

Apr. 21, 2006 (EP) ..... 06112926
Mar. 2, 2007 (WO) ..... PCT/EP2007/052003

(51) Int. Cl.
*B41J 11/00* (2006.01)

(52) U.S. Cl. ..... 347/101; 347/102; 347/212

(58) Field of Classification Search ..... 347/101, 347/102, 212, 220; 399/94, 121, 123
See application file for complete search history.

(56) References Cited

U.S. PATENT DOCUMENTS

| | | | | |
|---|---|---|---|---|
| 5,564,496 | A | 10/1996 | Blum et al. | |
| 5,856,650 | A | 1/1999 | Rise et al. | |
| 6,089,703 | A | 7/2000 | Pearson | |
| 6,754,457 | B2 * | 6/2004 | Ciaschi et al. | 399/92 |
| 2002/0043364 | A1 | 4/2002 | Suzuki et al. | |
| 2006/0225874 | A1 | 10/2006 | Shives et al. | |
| 2009/0116866 | A1 * | 5/2009 | Hollands et al. | 399/94 |

FOREIGN PATENT DOCUMENTS

| | | | |
|---|---|---|---|
| DE | 28 11 835 | A1 | 9/1979 |
| DE | 199 54 521 | C1 | 6/2001 |
| WO | WO 2007122033 | * | 11/2007 |
| WO | WO 2007122198 | * | 11/2007 |

* cited by examiner

*Primary Examiner*—Huan H Tran
(74) *Attorney, Agent, or Firm*—Birch, Stewart, Kolasch & Birch LLP

(57) ABSTRACT

A heat exchange laminate for use as a heat exchange member in a heat exchange unit for a printing system including a base layer extending substantially planar, said base layer being bilaterally coated with an electrical conductive non-metallic contact layer.

14 Claims, 5 Drawing Sheets

HEAT EXCHANGE LAMINATE

This application is a Continuation of copending PCT International Application No. PCT/EP/2007/053897 filed Apr. 20, 2007, which designated the United States, and on which priority is claimed under 35 U.S.C. §120, and which application further claims priority under 35 U.S.C. §119(a) on Patent Application No. 06112926.8 filed in Europe on Apr. 21, 2006 and which application claims priority on PCT International Application No. PCT/EP/2007/052003 filed Mar. 2, 2007, the entire contents of each application being incorporated by reference.

BACKGROUND OF THE INVENTION

The present invention relates to a heat exchange laminate for use as a heat exchange member of a heat exchange unit. The present invention further relates to the use of the heat exchange laminate and to a heat exchange unit and a printing system including such a heat exchange laminate.

A heat exchange member for printing systems is known from U.S. Pat. No. 6,089,703. This inkjet printing system uses a roll to transport thermal energy from a first position in the system to a second position. At the first position a pinch is formed by the roll and a further member and thermal energy is donated from a print media to the roll. This roll forms a second pinch at the second position, where the rotating roll donates its thermal energy to the paper during the passthrough of a print media through the second pinch.

It is a disadvantage of this kind of heat exchange system that the heat exchange efficiency is relatively low, due to the relatively large track over which the thermal energy is transported from the time it is donated until it is transferred to the receiving print media. The heat exchange efficiency is determined by the fraction of thermal energy which is put into the heat exchange system divided by the amount of thermal energy that is donated to the receiver. During the transport of thermal energy a lot of energy is dissipated away.

SUMMARY OF THE INVENTION

It is an object of the present invention to increase the heat exchange efficiency of the heat exchange member. To this end a heat exchange laminate for use as a heat exchange member in a heat exchange unit is provided, comprising a base layer extending substantially planar, said base layer being bilaterally coated with an electrical conductive non-metallic contact layer. The planar base layer, as part of the heat exchange laminate, results in an efficient contact with thermal energy donating or receiving media. In particular flat media, such as sheets of print media, are in operation commonly transported in flat transport paths along the heat exchange laminate. The base layer is constructed such that it comprises sufficient strength and the desired stiffness to act efficiently in a heat exchange unit. These properties may be chosen in dependence on the used thermal energy donating and receiving media, both the properties in the plane of the base layer as well as out of the plane.

The surfaces of energy donating and receiving media are not to be defaced by friction or surface roughness of the heat exchange laminate. The bilateral coating of the base layer with a contact layer is chosen such that friction and roughness of the heat exchange laminate surface are minimized, such that the energy receiving and donating media are not damaged. The media which are sliding against and along the media to exchange thermal energy may comprise marking material at a relatively high temperature. This means that the marking material may be quite sensitive for damages when it passes along the heat exchange laminate. A smooth surface of the heat exchange laminate with very little friction is therefore an important feature for application in such systems.

The coating of the base layer with a contact layer on both sides of the base layer is electrical conductive. This reduces the risk of blocking in a system wherein such a laminate is applied. Blocking is the occurrence of a barrier by the energy receiving or donating media in the transport path. Electrical isolating top surfaces may result in a static electrical charging of the thermal energy receiving and donating media. A statically charged media may demonstrate sticking, e.g., to the heat exchange laminate, to transport rollers or to other energy receiving or donating media.

It is also known to transport thermal energy from a first section of a printing system to another section by means of an active transport of thermal energy, such as disclosed in Offenlegungsschrift DE 28 11 835 A1. It is an advantage of the present invention that the heat exchange laminate is in particular suitable for passive use in a heat exchange unit. By using a heat exchange laminate as a stationary heat exchange member, the technical complexity of the system is reduced.

In an embodiment of the heat exchange laminate according to the present invention, the electrical conductive non-metallic contact layer is a graphite foil. Graphite is very suitable as a contact layer as the static electrical charging of a passing media is nihil. The graphite contact layer is furthermore very smooth and induces very little friction with a passing media. Furthermore the thermal conductive properties of graphite are very suitable for use in a heat exchange laminate.

In another embodiment of the heat exchange laminate according to the present invention, the base layer is a metallic sheet. The thermal energy which is donated on a first side of the heat exchange laminate should be efficiently transported towards the receiving side of the laminate, where it should be subsequently donated to a thermal energy receiving media. A metallic sheet as a base layer has positive thermally conductive properties for an efficient heat exchange over the thickness of the heat exchange laminate.

In a further embodiment of the heat exchange laminate according to the present invention, the metallic sheet comprises an iron-nickel alloy, comprising substantially 35% nickel. The iron-nickel-alloy with a nickel content of approximately 34-37%, preferably 35-36% nickel, has a substantially low coefficient of thermal expansion. This applies in particular to the face centered cubic crystal-formation of the iron-nickel-alloy. The use of this metallic alloy as a base layer in the heat exchange laminate results in a thermally stable base form. A base layer constructed from a material with a low Young's modulus and/or a low thermal expansion coefficient reduces the risk of wrinkling due to a high temperature gradient over the heat exchange laminate. In particular in applications with a cross-flow heat exchange concept, one end of the laminate has a higher temperature, e.g., the end near the print engine, or fuse station of a printer, than the other end in operation, e.g., the end near the paper trays and/or the delivery station. Even more, one side of the laminate, in particular the side of the transport path of the thermal energy receiving media is colder than the opposite side of the laminate, in particular the side of the transport path of the thermal energy donor. Thus, a relatively high temperature gradient in both the direction of thickness of the laminate as well as in the plane of the laminate may, in operation, result in a large gradient of thermal expansion of the laminate, potentially resulting in wrinkling the laminate.

In another embodiment of the heat exchange laminate according to the present invention, the base layer has a linear thermal expansion coefficient $\alpha$ smaller than $5 \cdot 10^{-6}$ m/m·K, preferably smaller than $2 \cdot 10^{-6}$ m/m·K. This results in a low risk of wrinkling the laminate when exposed to a large thermal gradient and therefore in a higher certainty in the operation of the heat exchange unit.

BRIEF DESCRIPTION OF THE DRAWINGS

The present invention will now be explained with reference to the following drawings, wherein.

DETAILED DESCRIPTION OF THE INVENTION

Figure 1:
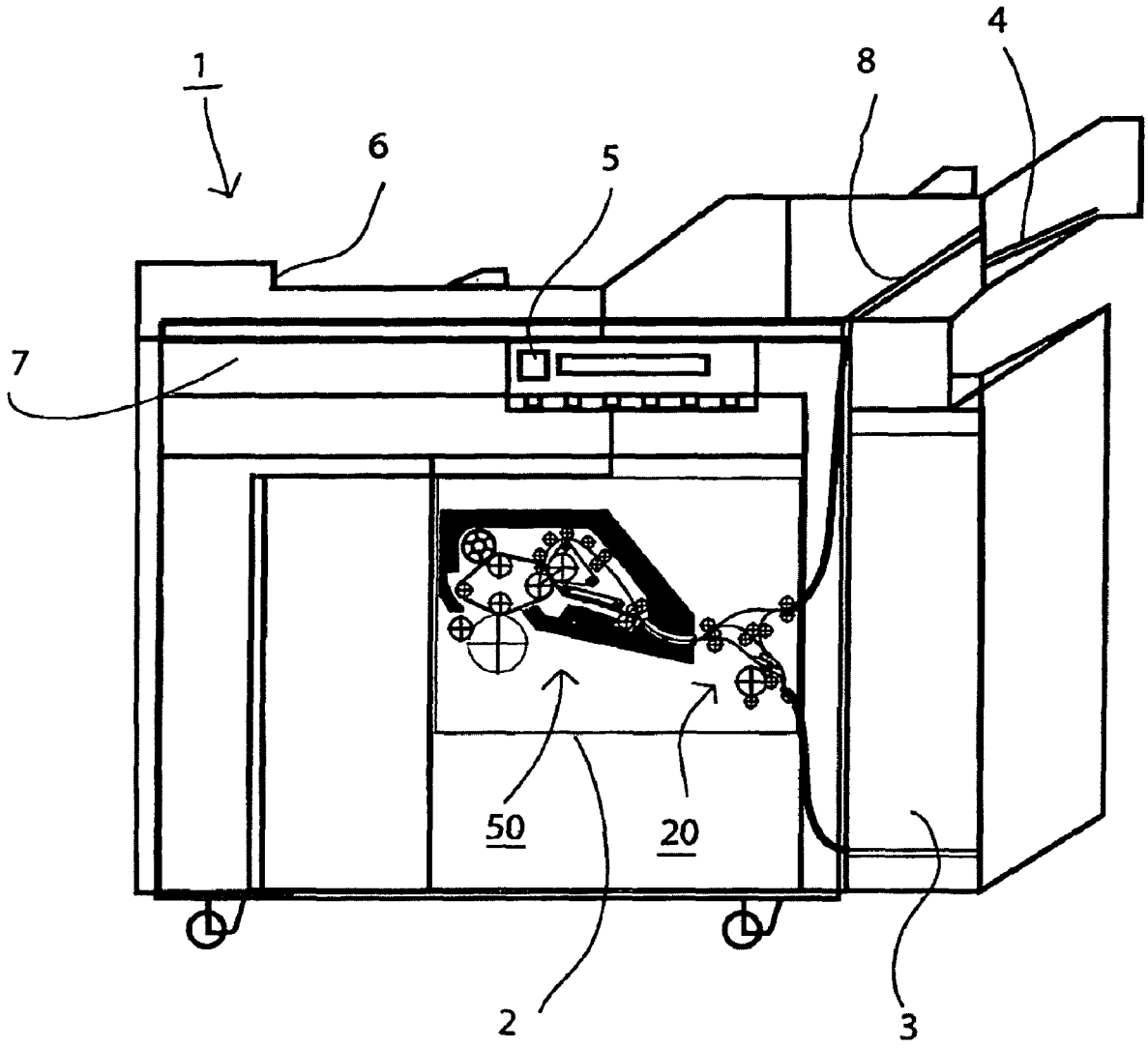
FIG. 1 is a schematic view showing a printing system comprising a heat exchange unit containing a heat exchange laminate according to an embodiment of the present invention.
Figure 2:
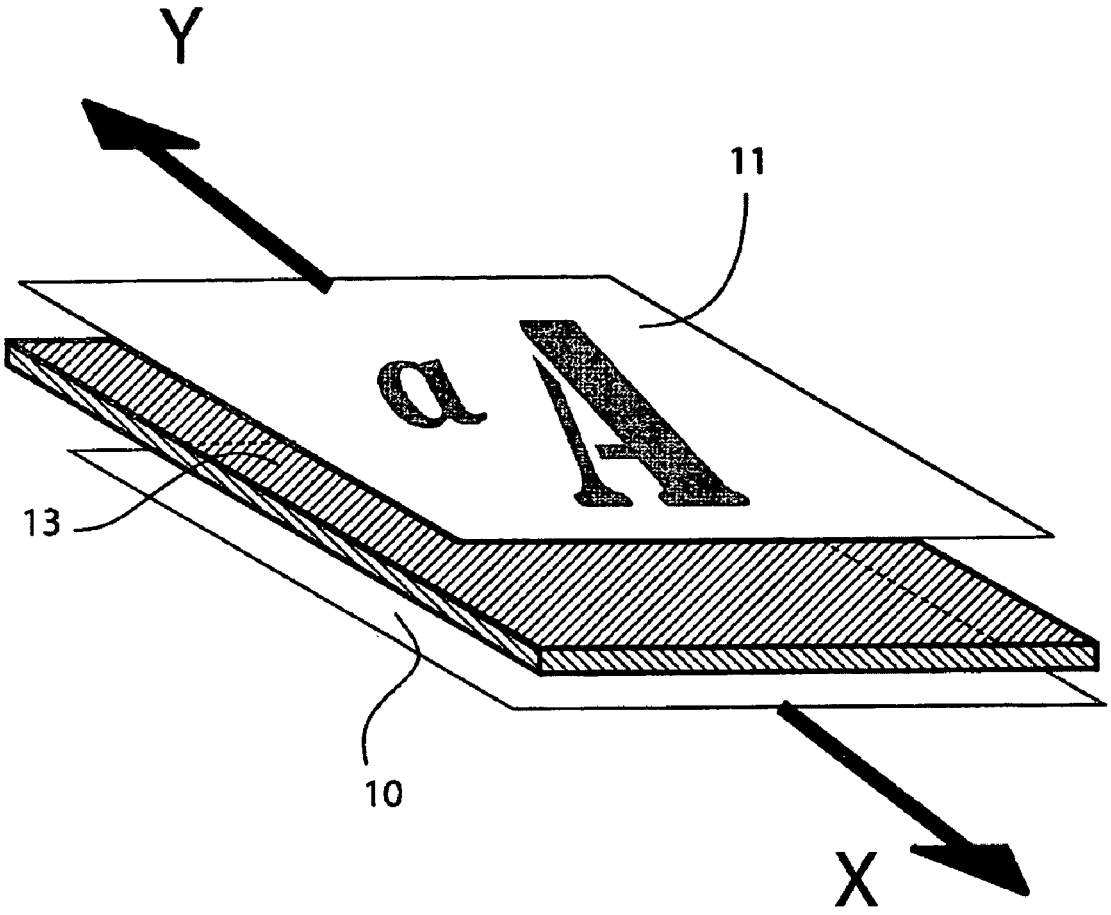
FIG. 2 is a schematic view of the heat exchange process according to an embodiment of the present invention.

FIG. 1 shows a schematic view of a printing system comprising a heat exchange unit including a heat exchange laminate according to an embodiment of the present invention. The printing system 1 has an engine 2 into which the paper is fed from a supply 3, preconditioned and printed with a printing process 50 and fed to a take-out area from which an operator can remove the printed media. The printing system 1 delivers marking material onto the print media in an image-wise fashion. This image can be fed, e.g., by a computer via a wired or wireless network connection (not shown) or by means of a scanner 7. The scanner 7 scans an image that is fed into the automatic document feeder 6 and delivers the digitized image to the printing controller (not shown). This controller translates the digital image information into control signals that enable the controller to control the marking units that deliver marking material onto an intermediate member. A preheated print medium is fed along the intermediate member, from which the image-wise marking material image is transferred onto the print medium. This marking material image is fused onto the print medium in a fusing step under elevated pressure and temperatures. The image bearing print medium is cooled down to a lower temperature before it is delivered to the take-out area 4. A user-interface 5 enables the operator to program the print job properties and preferences such as the choice for the print medium, print medium orientation and finishing options. The printing system 1 has a plurality of finishing options such as stacking, saddle stitching and stapling. The finishing unit 8 executes these finishing operations when selected. It will be clear to a person skilled in the art that other image forming processes wherein an image of marking material is transferred onto a print media, possibly via one or more intermediate members, e.g., electro(photo)graphic, magnetographic, inkjet, and direct imaging processes are also applicable. The print media 11 that are delivered from the print process 50 are at an elevated temperature because of heating in the print process 50 and heating in the fusing step. The heat exchange unit according to the present invention uses the thermal energy of these outgoing print media for the preheating of cold media that have to be preheated before entering the print process 50. The outgoing printed media 11 are transported through a heat exchange zone in the heat exchange unit 20. FIG. 2 shows a schematic view of this principle. A print medium 10 that is separated from a supply unit 3 is transported to the print process 50 in the direction marked with arrow X. The thermal energy of the printed media 11 that originates from the print process and the fuse step is transferred to the cold print media 10 through a thermal intermediate heat exchange member 13. While cooling the printed medium 11 down to an acceptable temperature in which the marking material is hardened and therefore less sensitive to smearing, the printed medium 11 is transported in the direction marked with arrow Y towards the take-out area 4 of the printing system 1.

Figure 3:
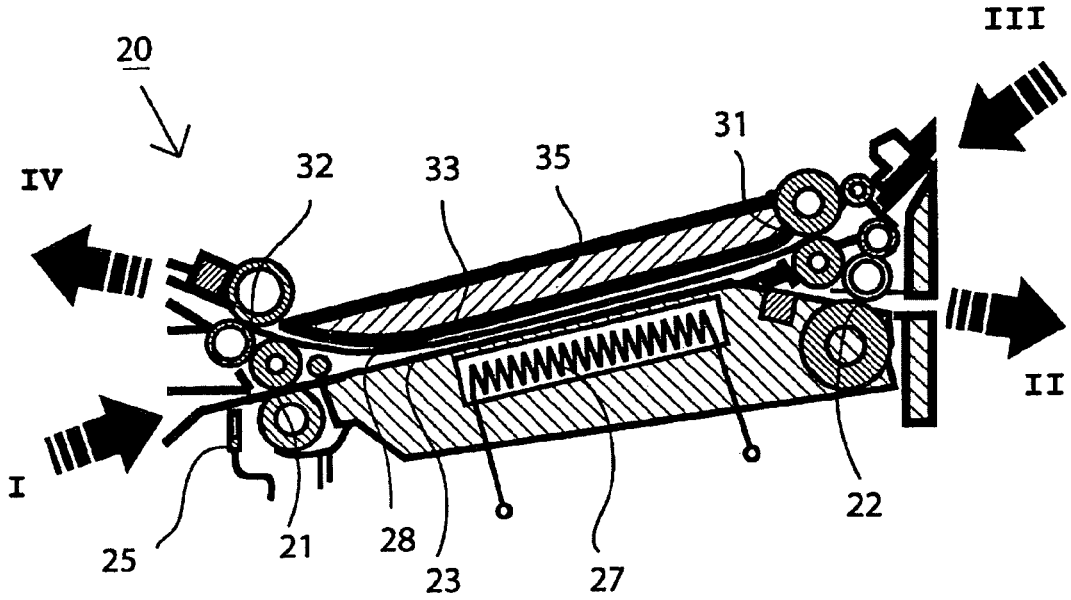
FIG. 3 is a schematic view of a heat exchange unit comprising a heat exchange laminate according to an embodiment of the present invention.

FIG. 3 is a schematic view of a heat exchange unit comprising a heat exchange laminate according to an embodiment of the present invention. A print medium is separated from a supply unit 3 and fed into the first print media transport path 23 of the heat exchange unit 20 in the direction of arrow 1. This entry into the heat exchange unit is registered by sensor 25. The print medium is moved into pinch 21, which pushes the print medium through the first print media transport path 23 towards pinch 22. Pinch 22 draws the print medium from area 23 towards the print process (not shown) in the direction of arrow II. Inside the print process the print medium is pre-heated by an electric pre-heater (not shown) to facilitate the image-wise application of marking material which is fused into the print medium under elevated pressure and temperature. Both the application of the marking material and the fusing of the marking material onto the print medium increase the temperature of the print medium. The print medium at elevated temperature is then ejected from the print process and fed into the second print media transport path 33 of the heat exchange unit in the direction of arrow III. Pinch 31 pushes the print media from the print process towards pinch 32. While the print media at elevated temperature is transported through the second print media transport path 33 a second print media is fed into the first print media transport path 23. As the first and second print media transport paths 23, 33 are having heat exchange contact, the first print media at elevated temperature in the second print media transport path donates its thermal energy partly to the second print media in the first print media transport path 23 which receives the thermal energy and heats up. Because the first print medium donates thermal energy to the second print medium, the preheater of the print process can lower its thermal dissipation.

In case of the absence of a print medium at an elevated temperature, e.g., at system start-up or after an interruption of print-activity, the heater element 27 can correct for the absence of the extra thermal energy as long as no print media at elevated temperature is available.

To improve the exchange of thermal energy between print media at elevated temperature in the second print media transport path 33 and the cold media in the first print media transport path 23 a pressing member 35 applies a pressure on the print media at elevated temperature such that the heat exchange efficiency increases. This pressure is high enough to increase the heat exchange efficiency and low enough not to disturb the passage of the print media too much. Pressing member 35 is a foam layer that applies approximately 100-200 Pa of pressure on the print media. The heat exchange member being stationary, i.e., the member does not move relative to the print media in the print media transport path, increases the efficiency of the heat exchange.

Figure 4B:
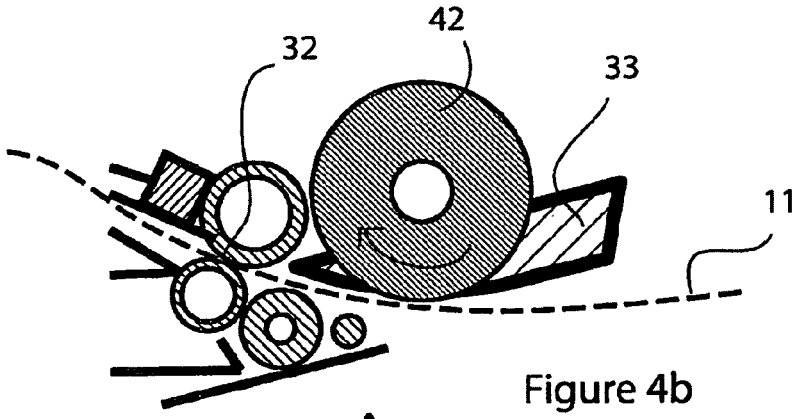
FIGS. 4*a* and 4*b* show schematic views of a heat exchange unit comprising rotatable guiding member according to an embodiment of the present invention.
Figure 4A:
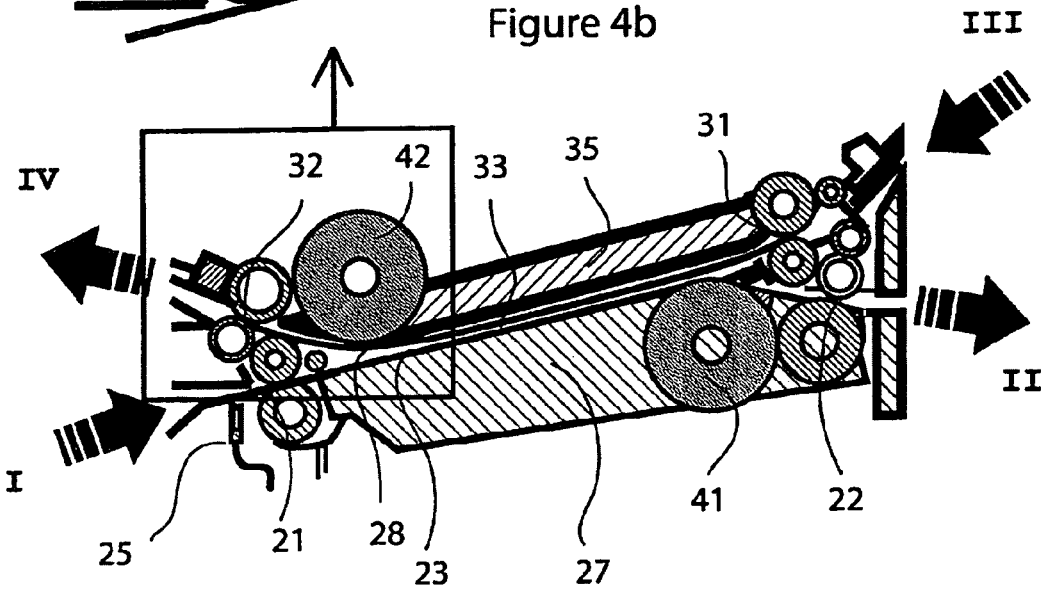

FIGS. 4*a* and 4*b* show schematic views of a heat exchange unit comprising rotatable guiding members according to an embodiment of the present invention. The boxed area of FIG. 4*a* is enlarged and depicted in FIG. 4*b*. At the exits of the print media transport paths 23, 33 guiding members 41, 42 are rotatably connected with the heat exchange unit. Print media 11 that are transported through the paper paths 23, 33 are initially pushed respectively by pinches 21 and 31 until the print media are fed into drawing pinches 22 and 32. These drawing pinches 22 and 32 draw the print media out of the print media transport paths 23 and 33. Because the print media inside of the print media transport paths 23, 33 are influenced by a certain amount of friction this drawing out of the print media 11 will put stress of the print media when drawn out. Especially at the curved exit areas of the print media transport paths 23, 33 can this stress occur. The freely rotatable guide members 41 and 42 decrease the stress on the print media 11 at these areas, thereby decreasing the risk of affecting the print media and image integrity.

To decrease the risk of smearing and cross-pollution of marking material from one print medium onto the other a thin and flexible heat exchange laminate 28 is disposed in between said first and second print media transport paths 23, 33. This thin flexible heat exchange laminate 28 is very smooth so that the print media are not obstructed while they are transported through the print media transport paths 23, 33.

To prevent static charging of the print media the heat exchange laminate foil 28 has electro-conductive properties. The foil 28 is resistant to wear and has a low sliding resistance. To improve the thermal behavior of the foil 28 during the heat exchange between the first and a second print medium, the foil is constructed very thin, such that the heating of the foil 28 itself does not obstruct the heat exchange between the print media. Therefore the heat capacity and thermal resistivity of the foil are adapted to exchange the heat between the first and second print media.

Figure 5A:
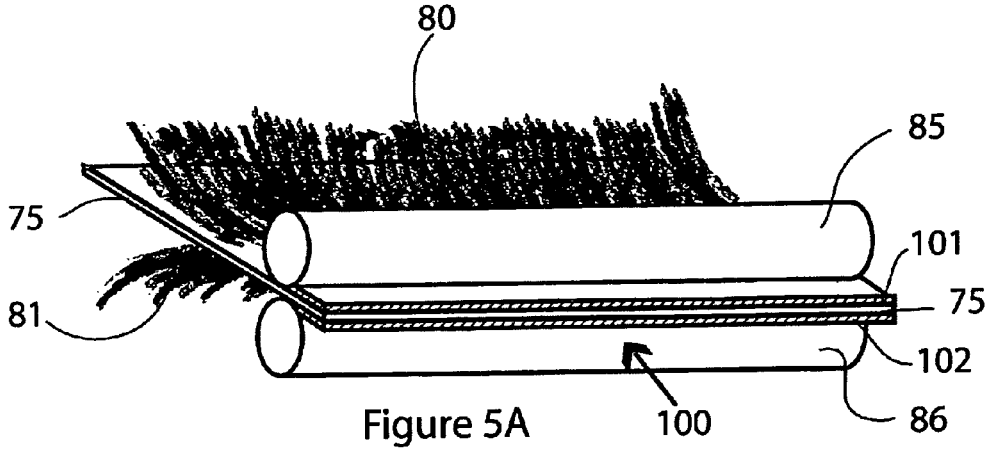
FIG. 5A shows a schematic view of a method of producing a heat exchange laminate according to an embodiment of the invention.

FIG. 5A shows a schematic view of a method of producing a heat exchange laminate according to an embodiment of the present invention. First a base layer 75 is fabricated. To this end a sheet of iron-nickel alloy, comprising substantially 35% nickel is cut into shape, such that the resulting laminate 100 will fit into a heat exchange unit for a printing system.

Graphite is ground into small particles of approximately 1 mm in diameter and 0.1 mm thickness. The graphite particles are expanded under elevated temperature in an acid environment, such that the volume of the graphite increases approximately 300 to 400 times its original volume. A continuous stream of this expanded graphite fabric is rolled into a thin layer structure. A length of the thin layer structure of graphite fabric 80, 81 is then introduced to each side of the base layer 75. The graphite fabric layers 80, 81 and the base layer 75 are then rolled under elevated temperature and pressed together to form a heat exchange laminate 100 formed of a base layer 75 bilaterally coated with and bonded to two graphite contact layers 101, 102.

Figure 5B:
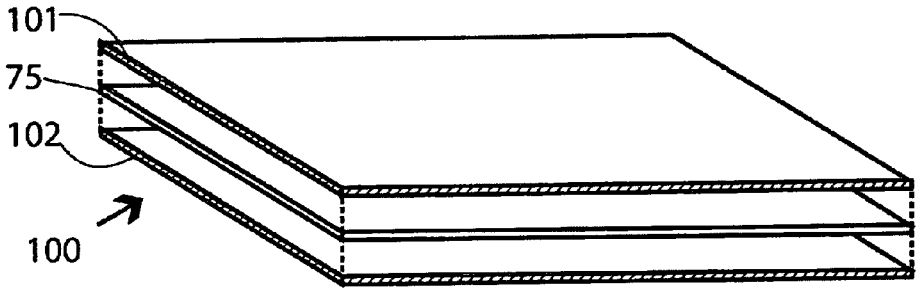
FIG. 5B shows a schematic exploded view of the heat exchange laminate.

FIG. 5B shows a schematic exploded view of the heat exchange laminate 100. Base layer 75 is bilaterally coated with and bonded to two contact layers of graphite 101, 102. The base layer 75 is a layer of a 35% nickel-iron alloy. This alloy has a very low coefficient of thermal expansion. Therefore a temperature gradient over the base layer 75, or heat exchange laminate 100, e.g., as a result of hot print media at a first side and cold print media at the opposite side, does result in large expansion differences. Therefore the heat exchange laminate will remain in its planar shape and will not wrinkle due to thermal differences over its surface during operation.

Figure 5C:
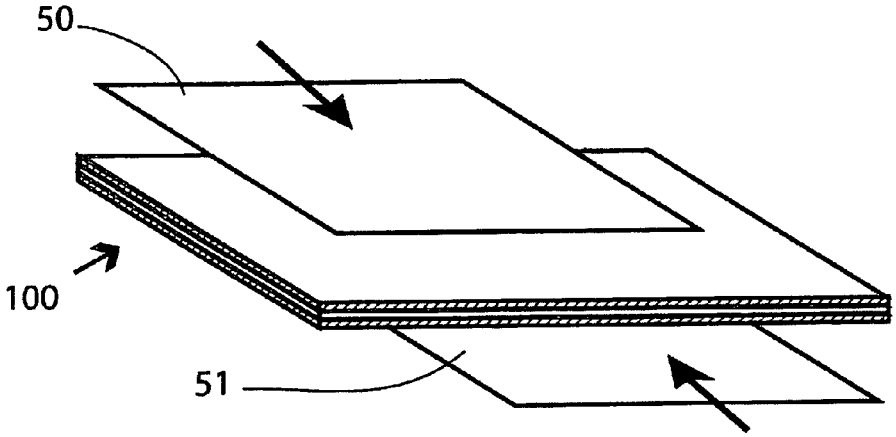
FIG. 5C shows a schematic operation of the heat exchange laminate in a printing system.

FIG. 5C shows a schematic operation of the heat exchange laminate in a printing system. The heat exchange laminate 100 is placed along the media transport path between the print media supply unit and the print engine. As depicted, a cold print media 51 is fed in one direction from the supply unit towards the print engine and on the opposite side of the heat exchange laminate a hot print media 50 is fed from the engine towards a delivery station. The hot print media 50 donates a portion of its thermal energy to the cold print media 51 via the heat exchange laminate 100.

Alternatively the streams of print media may be directed in the same direction on both sides of the heat exchange laminate.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A heat exchange laminate for use as a heat exchange member in a heat exchange unit, which comprises an iron nickel alloy metallic sheet as a base layer which extends substantially planar, said base layer being bilaterally coated with an electrically conductive non-metallic graphite foil as a contact layer.

2. The heat exchange laminate according to claim 1, wherein the iron-nickel-alloy comprises substantially 35% nickel.

3. The heat exchange laminate according to claim 2, wherein the iron-nickel-alloy has a face centered cubic crystal structure.

4. The heat exchange laminate according to claim 1, wherein the base layer has a linear thermal expansion coefficient $\alpha$, smaller than $2\cdot10^{-6}$ m/m·K.

5. A heat exchange unit containing the heat exchange laminate according claim 1.

6. A printing system containing the heat-exchange unit of claim 5.

7. A counter-flow heat exchange unit containing the heat exchange laminate of claim 1.

8. A printing system containing a heat exchange unit provided with the heat exchange laminate of claim 1 for cooling print media from a print engine and heating print media introduced into the print engine.

9. The heat exchange laminate of claim 1, which contains a low thermal expansion coefficient and a high thermal conductivity.

10. A heat exchange unit, comprising a heat exchange region, a first print media transport path configured for transporting, in operation, a first print medium from a supply through the heat exchange region to a print engine and a second print media transport path configured for transporting, in operation, a second print medium from the print engine through the heat exchange region, the heat exchange unit further including a stationary heat exchange member, having a first side facing said first print media transport path and a second opposite side facing said second print media transport path wherein, in operation, the second print medium is at an elevated temperature with respect to the first print medium and wherein the first and second print medium are adapted to have heat exchange contact in said heat exchange region, said stationary heat exchange member including a heat exchange laminate comprising a base layer extending substantially planar, said base layer being bilaterally coated with an electrical conductive non-metallic contact layer, said heat exchange laminate being disposed between the first print medium and the second print medium.

11. A printing system comprising a print media supply, a print engine for applying marking material to a print media and a heat exchange unit as defined in claim 10.

12. The heat exchange unit of claim 10, wherein the base layer is a metallic sheet and the electrical conductive non-metallic contact layer is a graphite foil.

13. The heat exchange unit of claim 10 wherein means are provided for establishing counter flow between the first and second print medium in the respective first and second print media transport paths.

14. The heat exchange unit of claim 10, wherein the heat exchange laminate compresses an iron nickel alloy metallic sheet as a base layer which extends substantially planar, said base layer being bilaterally coated with an electrically conductive non-metallic graphite foil as a contact layer.

* * * * *